US005330391A

United States Patent [19]

Mitchell

[11] Patent Number: 5,330,391

[45] Date of Patent: Jul. 19, 1994

[54] SPORTS GLOVE FOR BOWLING AND OTHER SPORTS

[76] Inventor: Kenneth R. Mitchell, 3811 Indianwood Dr., Columbus, Ind. 47203

[21] Appl. No.: 2,220

[22] Filed: Jan. 8, 1993

[51] Int. Cl.[5] ..... A63B 71/14

[52] U.S. Cl. ..... 473/59; 473/62; 2/161 A; 2/161.1; 2/917; 2/16

[58] Field of Search ..... 273/54 B, 166; 2/16, 2/20, 161 A, 163

[56] References Cited

U.S. PATENT DOCUMENTS

| | | | |
|---|---|---|---|
| 2,465,136 | 3/1949 | Troccoli | 2/161 A |
| 3,438,630 | 4/1969 | Petti | 273/54 B |
| 3,772,706 | 11/1973 | Brigidi | 273/54 B |
| 3,790,168 | 2/1974 | Hashimoto | 273/54 B |
| 4,309,991 | 1/1982 | DeMarco | 273/54 B |
| 4,590,625 | 5/1986 | Keim | 2/161 A |
| 5,163,678 | 11/1992 | Rogers | 273/54 B |

*Primary Examiner*—Vincent Millin
*Assistant Examiner*—William M. Pierce
*Attorney, Agent, or Firm*—Woodard, Emhardt, Naughton, Moriarty & McNett

[57] ABSTRACT

A sports glove for a bowler includes a glove body having partial digit sleeves for the third and fourth digits and a flexible cover attached directly to each of the digit sleeves for the third and fourth digits so as to create an enclosed pouch. Each pouch includes a cushioning pad disposed therein. The sports glove is modified so as to receive on a selective or optional basis a number of enhancement components which are intended to assist the bowler in the support, release and control of the bowling ball. These enhancements include foam wedges which are attached to the palm side to either increase or decrease the amount of hook on the bowling ball, a spacer strip to control the spacing of the third and fourth digits and a brace which also assists in controlling the amount of hook on the bowling ball. The cushioning pads which are enclosed within the pouches on the third and fourth digits assist in filling the gap between the hand and the bowling ball so as to provide better weight distribution and balance. These pads also cushion the joint of-the finger and protect the joint from impact. The cover which forms the pouch for the pads is a flexible and resilient material though relatively stiff which facilitates in reducing hyperextensions of the third and fourth digits. The pouch, cover and pad combination is applicable to other sports where hyperextended fingers are possible.

4 Claims, 4 Drawing Sheets

SPORTS GLOVE FOR BOWLING AND OTHER SPORTS

BACKGROUND OF THE INVENTION

The present invention relates in general to sports gloves to protect the hand and enhance performance for sports such as bowling. More particularly the present invention pertains to a glove which is modified to receive various detachable components and a plurality of cushioning pads on the palm side of the glove for the fingers. These cushioning pads are individually covered by corresponding panels which assist in reducing the risk of a hyperextension to the fingers.

One of the concerns with sports such as bowling, football and baseball is the possible hyperextensioning of one or more fingers when handling, lifting, and catching the ball. Another concern after a hyperextension of one of the fingers is the heeling process and how quickly the athlete can resume participation in the particular sport once a hyperextension has occurred.

When the sports glove according to tile present invention is specifically modified for bowling, various components are attached to the glove to provide performance enhancements for this sport. Some of these enhancements include means to control the spacing of the fingers and the release of the bowling ball with the desired spin or rotation. Other enhancements provide bracing and supporting components to add strength and control. By designing these enhancements to be easily attached and detached, a basic or standard glove body which is provided can be easily modified so as to include some, all or even none of the available component enhancements.

While the combination of options provided by the present invention is unique and while the individual component enhancements are specifically styled in a unique manner, bowling gloves have been used for many years. Currently, athletes in baseball and football use gloves not only to protect the hands but also to provide a greater sense of feel or control and to facilitate catching the particular ball. Although bowling gloves have been used for many years and although sports gloves are currently in use and have been for a number of years, there have been a number of modifications made to these gloves during this time as evidenced by some of the following United States patents:

| U.S. Pat. No. | Patentee | Issue Date |
|---|---|---|
| 3,770,270 | Ingold | Nov. 6, 1973 |
| 3,707,730 | Slider | Jan. 2, 1973 |
| 3,606,319 | Borden | Sept. 20, 1971 |
| 3,595,575 | Gooch | July 27, 1971 |
| 3,583,704 | Callanan | June 8, 1971 |
| 3,421,160 | Domenico | Jan. 14, 1969 |
| 3,398,951 | Disko | Aug. 27, 1968 |
| 3,559,212 | Skovron | Feb. 2, 1971 |
| 2,751,598 | Romeo | June 26, 1956 |
| 3,224,012 | Hamm | Dec. 21, 1965 |
| 3,564,613 | Fowler | Feb. 23, 1971 |
| 3,486,171 | Zierhut | Dec. 30, 1969 |
| 4,608,720 | Purin | Sep. 2, 1986 |
| 4,552,359 | McDonald | Nov. 12, 1985 |
| 4,496,151 | Tureaud | Jan. 29, 1985 |
| 4,531,735 | Kovacs | Jul. 30, 1985 |
| 4,386,775 | Kouros | Jun. 7, 1983 |

SUMMARY OF THE INVENTION

A sports glove for a bowler according to one embodiment of the present invention comprises a glove body having a palm side and an opposite back side, and having digit sleeves for the third and fourth digits of the bowlers hand, a first flexible cover attached to the digit sleeve for the third digit so as to create a first pouch therebetween, a second flexible cover attached to the digit sleeve for the fourth digit so as to create a second pouch therebetween, a first cushioning pad disposed within the first pouch and a second cushioning pad disposed within the second pouch.

One object of the present invention is to provide an improved sports glove for a bowler.

Related objects and advantages of the present invention will be apparent from the following description.

DESCRIPTION OF THE PREFERRED EMBODIMENT

Figure 1:
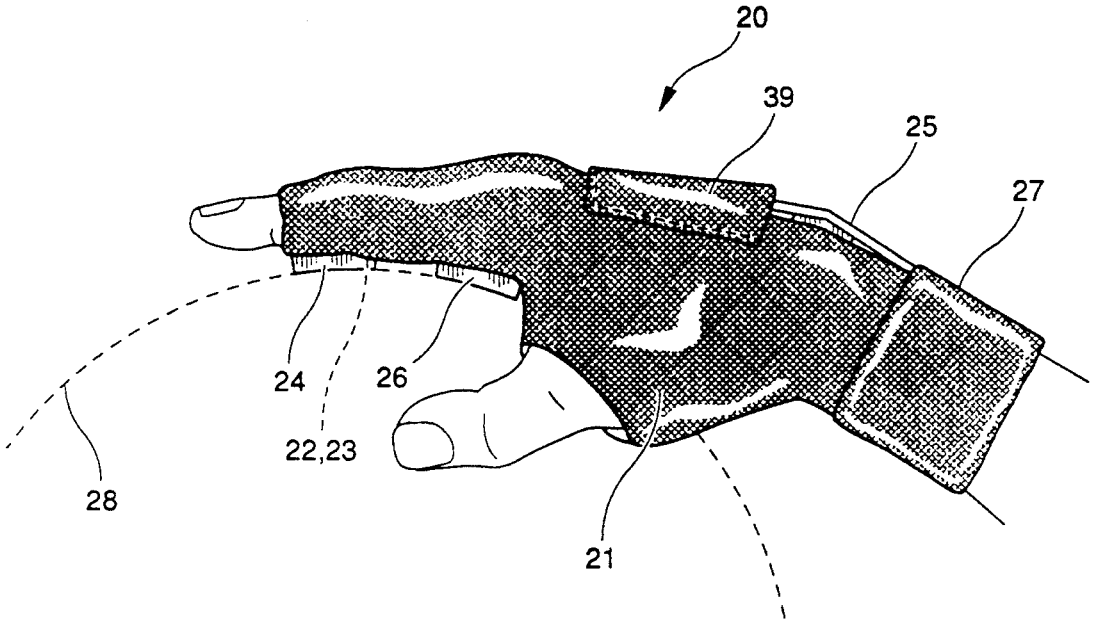
FIG. 1 is a perspective view of a sports glove positioned on the right hand of a bowler according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a bowling glove 20 as worn by a right-handed bowler which is modified and enhanced according to the present invention. Bowling glove 20 as fully modified includes a partial glove body 21, at least one finger pad 22 and cover 23 (best illustrated in FIG. 3), finger spacer strip 24 (on the palm side of the third and fourth digits), back wrist brace 25, foam wedge 26 and wrist wrap 27. Each of these modification and enhancement components has a particular purpose and function for a bowler and may be used singularly or in combination as they are somewhat separate and distinct as to their effect on the bowler and the release and control of the bowling ball. Certain ones of these modification components have applicability to other sports as will be described and explained hereinafter.

Also illustrated in FIG. 1 is a broken line 28 which in partial form is intended to generally illustrate the radius of curvature of the bowling ball. As will be described hereinafter, the foam pads which may be applied to the palm side of the FIG. 1 glove are shaped so as to conform to the curvature of the bowling ball and this broken line portion is a diagrammatical illustration of this curvature.

Figure 2:
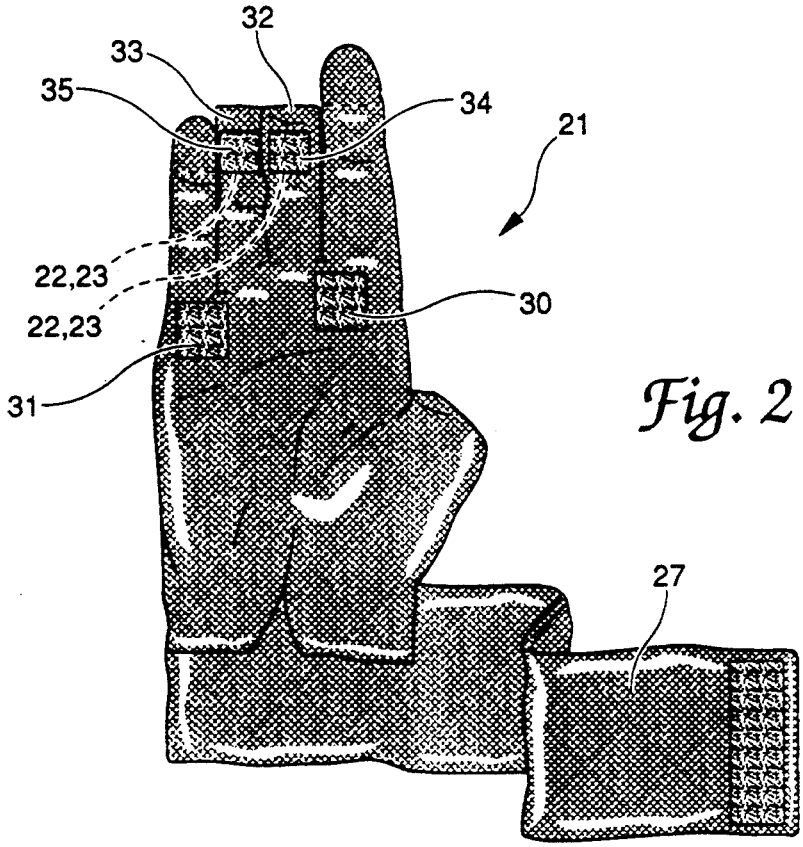
FIG. 2 is a top plan view of the palm side of the FIG. 1 glove body.
Figure 2A:
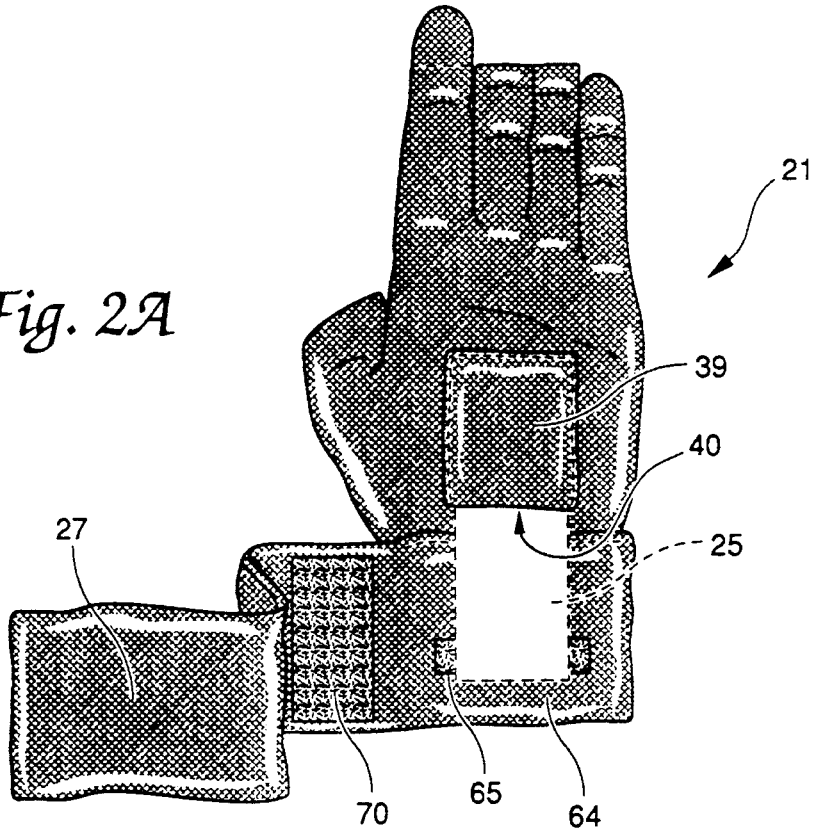
FIG. 2A is a top plan view of the back side of the FIG. 1 glove body.

Referring to FIGS. 2 and 2A, the palm side and back side of glove body 21, respectively, are illustrated. These drawing figures detail the manner in which an otherwise conventionally bowling glove is to be modified so as to receive in the designed manner the finger spacer strip 24, back wrist brace 25 and at least one wedge 26. While wrist wrap 27 could actually be a separate item, as will be described, it is cooperatively integrated directly into and a part of glove body 21. Wrist brace 25 is shown in phantom form in FIG. 2A.

Glove body 21 is a partial glove with the sleeve portion for the thumb removed and the ends of the sleeve portions for the third and fourth digits removed. The broken lines for the second and fifth digits indicate that these sleeve portions may also be cut back so as to allow the fingertips to extend. This is not important with regard to bowling unless the bowler prefers to have tile sleeve portion tips removed for the two fingers which simply brace and help support the weight of the bowling ball. The tips of the sleeve portion for the third and fourth digits must be removed as these (in addition to the thumb) are the portions of the bowlers hand which are inserted into the drilled holes of the bowling ball. To tile extent that the glove detailed in FIG. 1 may be used in other sports such as baseball and football, none of the sleeve portions of the glove body would need to be shortened although as mentioned the particular athlete may like to have the tips removed for a better sense and feel in grasping and throwing or carrying the ball.

While the thumb sleeve portion of the glove body 21 may be cut back to the area of the first metacarpophalangeal joint, the location at which point the sleeve portions are cut on the third and fourth digits is between the distal and proximal interphalangeal joints.

Sewn to each sleeve portions for the third and fourth digits (middle finger and ring finger) at the approximate location of the proximal interphalangeal joint is one of the covers 23. The corresponding sleeve portion of the glove body in cooperation with its cover 23 creates a small enclosed pouch (see FIG. 3). Disposed within this small pouch is a cushioning and support pad 22. The size of the pads 22 may vary with the size of the glove (i.e., size of the bowlet's hand) and the particular finger. However, any size variation within the pouch may be relatively minor. The pad size may also vary depending on the hole span of the bowling ball as will be described hereinafter.

Also on the palm side of the partial glove body 21 are two generally rectangular VELCRO pads 30 and 31. Pad 30 is positioned on the right side of the palm along the second metacarpal bone. Pad 31 is positioned on the left side of the palm along the line of the fifth metacarpal bone. Each pad is designed to receive a corresponding foam wedge 26 (see FIGS. 1 and 4) and the glove may be configured with only one wedge on either the left or on the right side or with two wedges using both VELCRO pads 30 and 31. The wedge 26 includes a foam block **26*a* cut so as to have five substantially flat surfaces, a concave upper surface, a generally trapezoidal cross section in a vertical plane and a generally rectangular cross section in a horizontal plane (excepting of course the effect of the concave upper face). The base includes a panel 26*b* of VELCRO adhesively joined to foam block 26*a***.

The foam wedge is effective to direct and control the release of the bowling ball. The use of only one wedge shifts the center of weight of the ball and creates more turn and rolling action on the ball, making it easier for the bowler to generate more power and pin action. A wedge on the right side of the FIG. 2 palm imparts more side roll to the bowling ball creating more hooking action. A wedge on the left side of the FIG. 2 palm imparts more forward roll creating a straighter motion to the bowling ball. The use of both left and right side wedges contributes to a better balance for the ball and creates more forward rolling action.

Also on the palm side of the partial glove body 21 (see FIG. 2), disposed as part of the sleeve portions 32 and 33 for the third and fourth digits (actually sewn in place) are VELCRO pads 34 and 35. While these pads may be either the hook-like portion of the VELCRO combination or the loop-like portion, when the portion is uncovered and able to contact the bowling ball, tile softer loop-like portion should preferably be used for pads 34 and 35, as well as for pads 30 and 31. These two pads engage the corresponding other half of the VELCRO combination which is disposed as part of finger spacer strip 24 (see FIGS. 1 and 5). The mating VELCRO portion on strip 24 in combination with pads 34 and 35 enable the bowler to determine his or her desired finger spacing (i.e., separation) for the two fingers which are inserted into the bowling bowl and securely fix that desired finger spacing. In this way the bowlet's release of the bowling ball is smoother and there is better control. By controlling and fixing the side-to-side spacing of the fingers, there is a better weight distribution and balance between the two fingers thereby providing better control. The two fingers act together as a single unit due to the presence of the finger spacing strip.

The top portion of strip 24 includes a concave foam pad 36 whose thickness may vary depending upon a number of factors, including the hand size of the bowler and the span between the two finger holes and the thumb hole which are drilled in the bowling ball.

Figure 6:
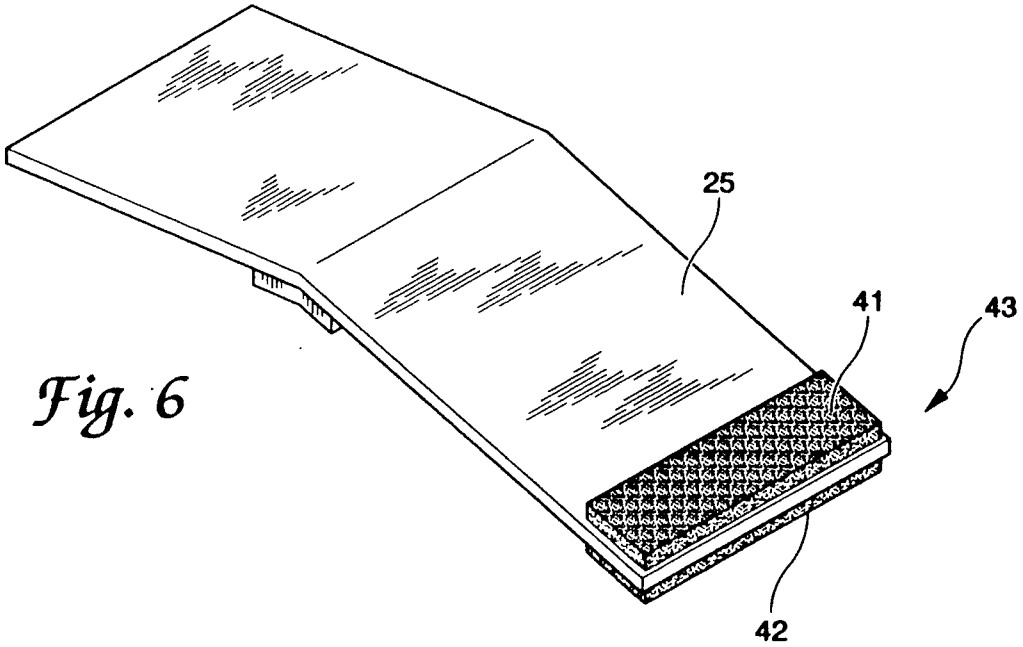
FIG. 6 is a perspective view of a back wrist brace which comprises one of the various enhancement options for the FIG. 1 sports glove.

On the back side of the partial glove body 21 is a pouch 39 which is sewn directly to the glove body along three sides leaving an open end 40 near the wrist. The back wrist brace 25 is able to be inserted into the pouch 39 as a means of securing one end of the brace in position. As illustrated in FIG. 6 the back wrist brace is bent slightly, approximately a 19 degree acute included angle, and VELCRO pads 41 and 42 are attached on both sides at free end 43 which extends out of pouch 39. The back wrist brace may be inserted into the pouch 39 on the glove body with the included angle facing down or the brace may be inserted into the pouch, turned 180 degrees, on axis, so that the included acute angle faces upwardly. The back wrist brace influences ttle amount of hook on the bowling ball. When oriented as in FIG. 1 such that the included angle is facing down there is more hook imparted to the ball. When the back wrist brace is inverted such that the included angle opens upwardly, there is less hook imparted to the bowling ball.

The wrist wrap 27 which is integral with the glove body in the preferred embodiment is used to brace and strengthen the wrist and gives the bowler better control of tile bowling ball. This wrist wrap also includes a means to secure the free end 43 of the wrist brace 25 by placing VELCRO on the wrist wrap at the precise locations which will be engaged by VELCRO pads 41 and 42 regardless of the orientation of the wrist brace 25.

Figure 3:
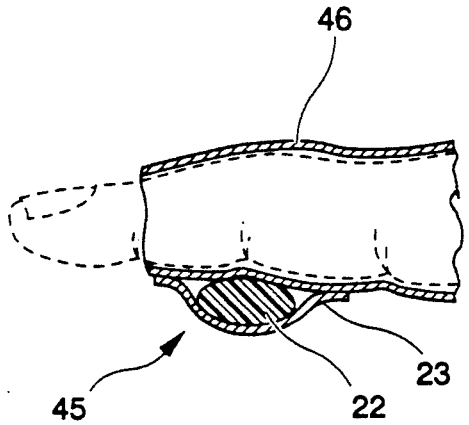
FIG. 3 is a side elevational view of one finger sleeve, a covering panel and a cushioning pad disposed therebetween according to the present invention.

Referring to FIG. 3 one representative (generic) finger sleeve pouch 45 is illustrated as including glove sleeve portion 46 and cover 23. As is illustrated, the cover 23 is sewn to the exterior surface of sleeve portion 46 so as to span the proximal interphalangeal joint. The material for sleeve portion 46 and in fact for sleeve portions 32 and 33 is the same elastomeric material as that used for cover 23. Further, although illustrated as a side elevational view in full section, the cover 23 is an oblong/oval panel which is sewn around its entire peripheral edge directly to the corresponding sleeve portion so as to completely enclose pad 22. It is also to be understood that the pad size may be increased and additional pouch/pad combinations may be used at other joints and for other digits. In the preferred embodiment two such pouch/pad combinations are used, one for the proximal interphalangeal joint of the third digit and one for the proximal interphalangeal joint of the fourth digit.

While hyperextended fingers can easily occur in sports, there are industrial situations as well which may result in a hyperextended finger. One example of the industrial situation would be carrying or lifting a heavy object where the fingers might be bent back beyond their normal extension and thereby become hyperextended. The result, whether by an industrial situation or by sports, is a very sore finger which will be tender for several days during the healing process. By the design of the present invention the cover 23 and pad 22 cooperate to both reduce the chance of a hyperextended finger and if hyperextended, aid in the healing process. In order to achieve these beneficial and novel results the cover 23 and pad 22 function in the following manner.

Cover 23 is made out of a flexible, resilient elastomeric material with a relatively high modulus of elasticity creating a fairly stiff panel of material. The stiffness of the cover material enhances the lift to be imparted to the bowling ball in addition to its value in reducing hyperextension of the fingers. Each cover is sewn directly to the partial glove body (directly to one of the digit sleeves) so that it spans the proximal interphalangeal joint of the corresponding of the digit. When that digit begins to be bent backwards, the result of lifting a heavy object or some sporting activity where a ball or contact pushes back against the hand, the cover begins to stretch. The elasticity and resiliency of the cover material and the sleeve portion(s) material in combination with its stiffness creates a substantial return force on the digit acting against the bending force. The digit does not have as much freedom to be hyperextended because of the stiff cover resisting the stretching action which is induced in it as the fingers are bent back. Without the cover 23 the digit is unrestrained and much lower levels of bending force can result in a hyperextended finger. As indicated, the sleeve material for sleeve portions 32, 33 and 46 acts as a brace to the corresponding joint. As such this concept as illustrated in FIG. 3 could be applied to any appendage joint of the anatomy.

While the proximal interphalangeal joint is likely the most susceptible joint of the hand to be hyperextended, the concept of cover 23 can be employed over any digit joint as well as other joints of the anatomy. For example, a stiff cover spanning the wrist from the area of the carpal-metacarpal joints to the radius and ulna can assist in protecting the wrist area from strain or hyperextension.

While pad 22 does not contribute in a major way to preventing hyperextensions to the fingers, it does contribute in a major way to the healing process once an hyperextension has occurred. The presence of pad 22 within cover 23 provides cushioning to the affected joint. Since a hyperextended joint is very tender, it is important to protect the joint during the healing process so that it is not further traumatized while trying to heal. Pad 22 provides a protective layer for the joint and cushions it against impact.

During the healing process cover 23 continues to serve a very important role in order to restrain the finger and reduce irritation to the sore and tender joint by holding it in place against moderate back-bending forces. A further function served, at least in part by pad 22, is to fill any gap or void between the inside surfaces of the third and fourth digits and the outer surface of the bowling ball. These two fingers are inserted into the bowling ball along a first line where two side-by-side holes are drilled. There is also a hole drilled for the thumb along a second line. The distance between these two lines is a span dimension that must be sized to the bowlet's hand. Typically there is some noticeable gap between the palm side of the hand and the outer surface of the bowling ball and this means greater forces on the fingers and thumb which are inserted into the drilled holes. If this gap area could be filled it would mean a greater area of contact in order to distribute the bowling ball weight and thereby lessen the weight load on the two fingers and the thumb which are inserted into the drilled holes.

Pad(s) 22 are used to fill (or partially fill) the air gap left between the fingers and the bowling ball. Since different bowlers prefer different span dimensions, it is envisioned as one option that pad 22 may be varied so as to provide different surface areas and different thicknesses. However, so as to preclude hundreds of different glove styles where each one has a slightly different pad dimension, other features of bowling glove 20, to be described hereinafter, are used in order to assist in filling any void or gap between the third and fourth digits and the outer surface of the bowling ball. In particular, a second foam pad may be used on the palm side of the third and fourth digits as part of the finger spacer strip 24 to provide additional thickness over what may be initially provided by pads 22. Consequently, the size selection of pads 22 must be made with this other glove feature in mind.

Figure 4:
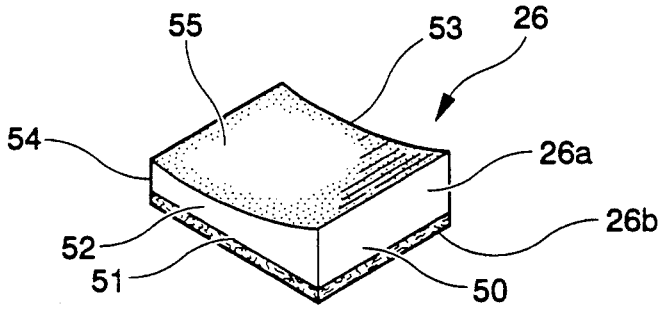
FIG. 4 is a perspective view of one foam wedge which may be attached to the palm side of the FIG. 1 glove body.

Referring to FIG. 4 one foam wedge 26 for use on the palm side of the glove body 21 in cooperation with VELCRO pads 30 and 31 is illustrated in greater detail. The foam block **26*a* of wedge 26 has a substantially flat rear surface 50, a substantially flat base 51 and oppositely disposed and substantially flat side walls 52 and 53. By providing a short front wall 54 which is generally parallel with rear surface 50, the shape of each side wall comes generally trapezoidal. Top surface 55 is concave with a radius of curvature which is close to that of a typical bowling ball so that compression of wedge 26 by the weight of the bowling ball will generally be evenly distributed over the area of the top surface 55. Cutting through foam block 26***a* along a geometric plane which is substantially parallel to base 51 yields a generally rectangular cross sectional shape until the curvature of top surface 55 is intersected. It is also envisioned that the curvature of top surface 55 could be cut so as to intersect the lower front corner which is now formed by the front wall 54 and base 51. In this configuration the front wall is eliminated and the vertical cross sectional shape from side wall to side wall is generally triangular.

VELCRO panel 26*b* is adhesively bonded to base 51 of foam block 26*a* and the VELCRO pattern is selected to compliment that of pads 30 and 31 such that foam wedge 26 can be readily attached to and detached from glove body 21. As indicated, a foam wedge 26 can be applied to either pad 30 or pad 31 or two foam wedges 26 can be attached to both pads 30 and 31.

Figure 5:
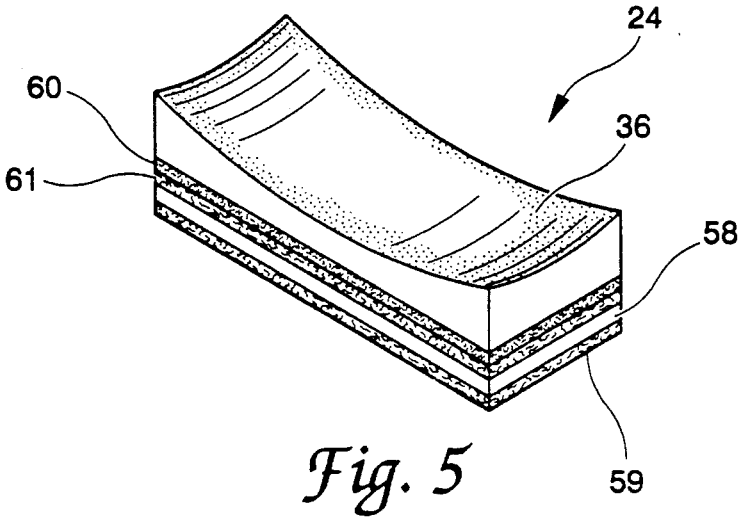
FIG. 5 is a perspective view of a finger spacer strip designed to be attached to the digit sleeves of the FIG. 1 glove body for the third and fourth digits of the bowlet's right hand.

Referring to FIG. 5 finger spacer strip 24 is illustrated in greater detail. Strip 24 includes a main panel 58 of flexible material with a layer 59 of VELCRO on one side and foam pad 36 on the opposite side. The VELCRO layer 59 is selected so as to compliment the two VELCRO pads 34 and 35 sewn to sleeve portions 32 and 33, such that the strip is used to fix and control the spacing of the third and fourth digits. When reference herein is made to one VELCRO layer or pad being selected so as to compliment some other layer or pad, it is to be understood that the VELCRO combination includes both hook-like projections on one portion and loop-like projections on the opposite and engaging portion. As should be understood, it does not matter which portion of the VELCRO combination goes where as long as that combination includes one layer or pad of each type so that engagement in the intended fashion is possible.

The foam pad 36 is fixed to the top surface of panel 58 by a suitable adhesive in one embodiment of the present invention. In the preferred embodiment the foam pad is attached directly to the top surface of the main panel by a pair of cooperating and mating strips 60 and 61 of VELCRO. The use of VELCRO to secure the foam pad 36 to the main panel allows the pad to become a variable component. The glove may be used with the spacer strip with or without the foam pad and the foam pad may be varied as to its thickness. The top of the foam pad 36 is concave with a relatively large curvature radius to conform generally to the curvature of the bowling ball. In this way the foam pad 36 cooperates with wedges 26 to support (cradle) and balance the bowling ball.

Referring to FIG. 6 the back wrist brace 25 is illustrated in greater detail. As described, the brace 25 fits into pouch 39 which is sewn to the back side of partial glove body 21. The free end 43 of the brace which extends out the open end 40 of the pouch includes the two VELCRO pads 41 and 42 which are of the same style so the brace can be turned without affecting the designed attachment to the wrist wrap. The brace is made of a rigid plastic, or alternatively metal, and VELCRO pads are adhesively attached to the surface. Foam pads are disposed on the concave side of the 19 degree bend.

Figure 7:
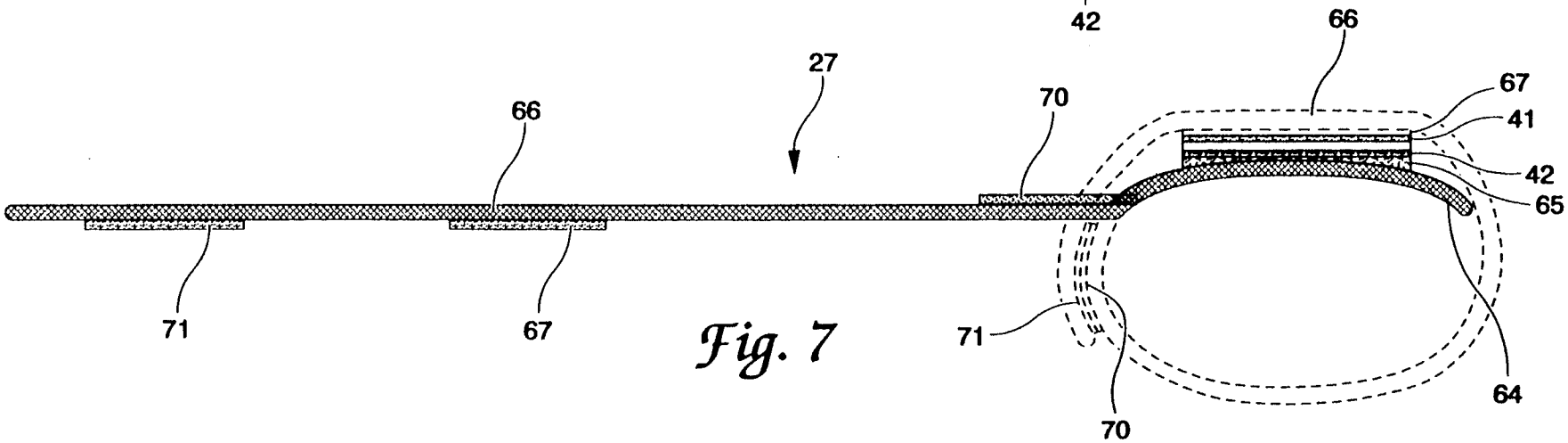
FIG. 7 is a diagrammatic illustration of the FIG. 6 wrist brace as secured in position by and within the wrist wrap of the FIG. 1 sports glove.

The back wrist brace 25 is sized that the 19 degree included angle is bent in the approximate center of the brace as running longitudinally from end to end so that this bend is positioned directly over the wrist area of the bowlet's hand. The free end extends into the forearm area and is secured with wrist wrap 27 as is illustrated in FIG. 7. The wrist wrap 27 is provided with a sufficient length so as to include a first layer 64 directly over the wrist/forearm area of the bowler and enough material to encircle the wrist. A first strip 65 of VELCRO material is sewn to this first layer 64. This strip of VELCRO material is then able to receive either VELCRO pad 41 or pad 42 depending upon the orientation of back wrist brace 25. The wrist wrap 27 also receives the free end 43 of the brace. The lamination of the layers of wrist wrap 27 and wrist brace 25 as illustrated in FIG. 7 is intended to illustrate one of several possibilities.

As is illustrated in broken line form, the second layer 66 of wrist wrap 27 which goes around and over the wrist brace includes a second strip 67 of VELCRO which is sewn to wrist strap 27 so as to engage the opposite side pad (41 or 42) of brace 25. Here again it should be pointed out that VELCRO pads 41 and 42 which are on the free end 43 of brace 25 are aligned with each other and thus the positioning of VELCRO strips 65 and 66 as part of wrap 27 are not dependent upon the particular orientation of brace 25. There are additional strips 70, 71 of VELCRO material as part of wrist strap 27 in order for the wrist wrap to be attached to itself.

In the preferred embodiment the wrist wrap is integrally attached as part of the glove body as is illustrated in FIGS. 1, 2, and 2A, however, it is possible and contemplated to use a wrist wrap that is separate from the glove body. In this situation, it is envisioned that the wrist wrap would be virtually identical in construction whereby its length and positioning of the various VELCRO strips would not change and the wrist wrap would still be used to securely receive the free end of the back wrist brace 25.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A sports glove for a bowler comprises:

a glove body having a palm side and oppositely disposed back side and having open-tipped glove sleeves for the third and fourth digits of a hand;

first pouch means disposed as part of the glove sleeve for the third digit for receiving therein a first cushioning member;

second pouch means disposed as part of the glove sleeve for the fourth digit for receiving therein a second cushioning member;

a first cushioning member disposed in said first pouch;

a second cushioning member disposed in said second pouch;

a pair of spaced-apart attachment pads secured to the palm side of said glove body;

a pair of foam wedges one each being secured to a different one of said attachment pads;

a spacer strip secured at one end to the glove sleeve for the third digit and secured at another, opposite end to the glove sleeve for the fourth digit;

a wrist strap secured to said glove body; and an invertible brace applied against the back side of said glove body and secured in position by said wrist strap.

2. The sports glove of claim 1 wherein said glove body and said first and second pouch means are fabricated out of an elastomeric material.

3. The sports glove of claim 2 wherein said first pouch means and said second pouch means are each sewn directly to the corresponding glove sleeves.

4. The sports glove of claim 3 wherein said invertible brace includes a bend therein so as to be configured into two diverging portions and being constructed out of metal.

* * * * *

UNITED STATES PATENT AND TRADEMARK OFFICE

CERTIFICATE OF CORRECTION

PATENT NO. : 5,330,391

DATED : July 19, 1994

INVENTOR(S) : Kenneth R. Mitchell

It is certified that error appears in the above-indentified patent and that said Letters Patent is hereby corrected as shown below:

Col. 1, line 23, replace "tile" with --the--.

Col. 3, line 29, replace "tile" with --the--.

Col. 3, line 36, replace "tile" with --the--.

Col. 3, line 55, replace "bowlet's" with --bowler's--.

Col. 4, line 27, replace "tile" with --the--.

Col. 4, line 37, replace "bowlet's" with --bowler's--.

Col. 4, line 64, replace "ttle" with --the--.

Col. 5, line 6, replace "tile" with --the--.

Col. 6, line 33, replace "bowlet's" with --bowler's--.

Col. 8, line 2, replace "bowlet's" with --bowler's--.

Signed and Sealed this

Twenty-fifth Day of October, 1994

*Attest:*

*Attesting Officer*

Bruce Lehman

BRUCE LEHMAN

*Commissioner of Patents and Trademarks*